United States Patent [19]

Demnianiuk

[11] 4,314,736

[45] Feb. 9, 1982

[54] ZERO INSERTION FORCE CONNECTOR FOR A PACKAGE WITH STAGGERED LEADS

[75] Inventor: Eugene F. Demnianiuk, San Diego, Calif.

[73] Assignee: Burroughs Corporation, Detroit, Mich.

[21] Appl. No.: 133,099

[22] Filed: Mar. 24, 1980

[51] Int. Cl.[3] ..... H01R 13/62

[52] U.S. Cl. ..... 339/74 R; 339/75 M; 339/75 MP

[58] Field of Search ..... 339/17 CF, 74 R, 75 M, 339/75 MP

[56] References Cited

U.S. PATENT DOCUMENTS

| | | | |
|---|---|---|---|
| 3,553,630 | 1/1971 | Scheingold et al. | 339/74 R |
| 4,080,032 | 3/1978 | Cherian et al. | 339/75 M |
| 4,196,955 | 4/1980 | J. Anhalt | 339/74 R |
| 4,223,370 | 9/1980 | Quere et al. | 339/17 CF X |

*Primary Examiner*—Joseph H. McGlynn
*Assistant Examiner*—Frank H. McKenzie, Jr.
*Attorney, Agent, or Firm*—Charles J. Fassbender; Kevin R. Peterson

[57] ABSTRACT

Disclosed is a zero insertion force connector for receiving and electrically connecting a staggered lead integrated circuit package to other conductors. The connector comprises parallel rows of staggered spring biased connector leads to receive the package leads, which are spring biased toward an open position for receiving the package leads, and which are moved into and held in engagement with the package leads against their bias by oppositely acting camming devices to provide a mechanical, positive, connection with the package leads, said spring biased connector leads also serving to open said connector leads against the camming force as the camming action is reversed.

6 Claims, 6 Drawing Figures

ZERO INSERTION FORCE CONNECTOR FOR A PACKAGE WITH STAGGERED LEADS

BACKGROUND OF THE INVENTION

This invention relates to connectors of the zero insertion force type for receiving and connecting an integrated circuit package with staggered leads to a printed circuit board or the like.

There are number of prior art zero insertion force type connectors for integrated circuit packages such as the patent to Cherian et al U.S. Pat. No. 4,080,032 granted Mar. 21, 1978 and the patents cited as prior art therein.

The connector of the Cherian et al patent operates by opening its normally closed spring contacts, on package lead engaging members, by a camming action and upon deactivation of this camming action, allowing the spring force of these contact members to close onto the leads of the package. Thus, electrical contact between the package leads and the connector leads depends upon the spring action of the connector leads. It can be appreciated that any such electrical connection is dependent upon the springs retaining their bias and any loss of this bias will result in a poor electrical connection due to the poor engagement between the package leads and the connector leads.

Too, with the emphasis today upon increasing the number of functions per chip and decreasing the size of the package, the use of staggered leads on a package is becoming increasingly popular since it allows more leads per package of a given size. The connector of the Cherian et al patent does not accept a staggered lead package.

This invention, however, discloses how a connector having a cam actuated spring device can accommodate staggered package leads and, being the reverse of the prior art, how the camming action asserts a positive mechanical force to create the electrical connection between the package leads and the connector leads instead of relying on any spring bias to make such a connection.

SUMMARY OF THE DISCLOSURE

A zero insertion force connector for receiving and electrically connecting a staggered lead integrated circuit package to other conductors. The connector contains parallel rows of staggered spring biased connector leads to receive the package leads, which are spring biased toward an open position for receiving the package leads, and are moved into and held in engagement with the package leads against their bias to provide a mechanical, positive, connection with the package leads, by oppositely acting camming devices, which drive a plurality of connector leads engaging arms, located in parallel and on opposite sides of the rows of connector leads, into engagement with the connector leads, said connector engaging arms also are responsive to said biased connector leads to open said connector leads against the camming force as the camming action is reversed.

BRIEF DESCRIPTION OF THE PREFERRED EMBODIMENT

Figure 4:
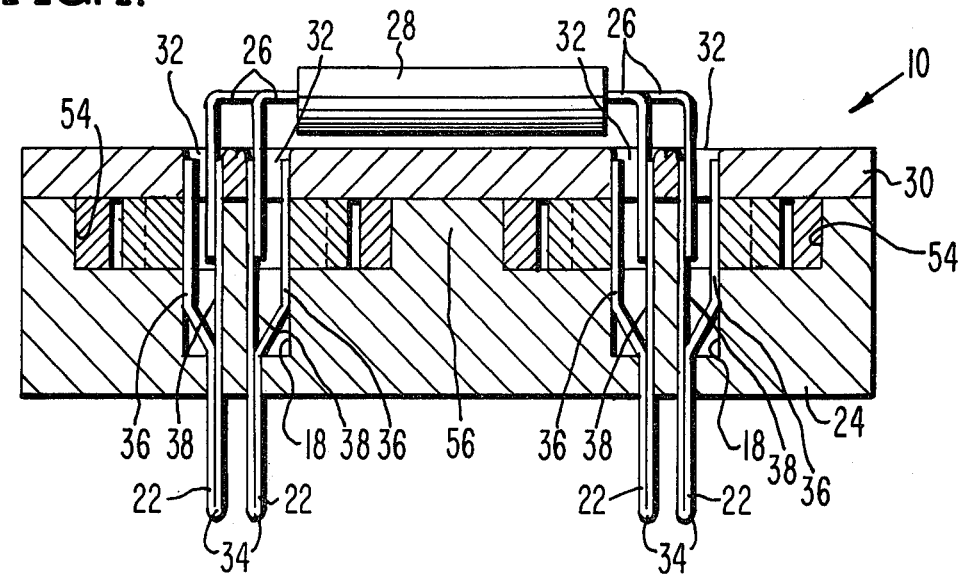
FIG. 4 is a cross-sectional view, taken along line 4—4 of FIG. 4, to illustrate the insertion of a package with staggered loads into the connector through the cover (not shown in FIG. 3)
Figure 6:
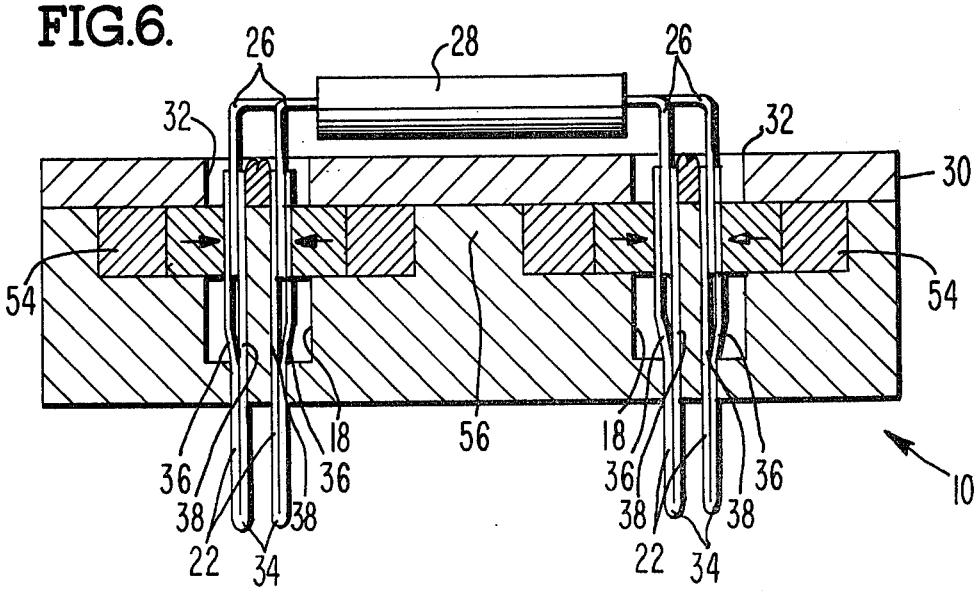
FIG. 6 is a view similar to FIG. 4, taken along line 6—6 of FIG. 5, and showing the connector leads in engagement with the package leads.

Turning now to the drawings, the zero insertion force connector 10 comprises a relatively flat, substantially rectangular body 12 of any suitable plastic material having side walls 14 which define a recess or cavity 16 with parallel spaced apart pairs of rows of deeper recesses in 18 (FIGS. 4 and 6) containing a plurality of connector leads 22 extending through the connector base 24 for electrical connection in a suitable manner to other connectors as by wire wrapping or formed on a printed circuit board.

The connector leads 22 are staggered in the pairs of parallel rows to receive the staggered package leads 26 of the integrated circuit package 28 when the package is mounted on a top cover 30 of the connector 10. A cover 30 is provided with apertures 32 to receive the staggered package leads; one aperture for each lead and located to correspond with each connector lead 22 and to guide each package lead into its respective package lead. Each connector lead 22 is formed as by bending a resilient flat conductor wire back on itself as at 34 to provide a back-to-back contact extension from the base 24 with one portion 36 flared and separated from the other portion 38 to form a space to allow the staggered package leads to be inserted therebetween. The space between the flared portions 36 and the other portion 38 is large enough to accept the package leads and are biased in a direction away from each other. When the staggered package leads are inserted into the connector leads, the separated portions are forced together mechanically to engage the inserted package leads to form a positive electrical connection between the package and the connector leads. The insertion force in the open connector leads is zero yet a mechanical positive clamping contact is accomplished when the connector leads are forced into engagement with the package leads.

To actuate the connector leads so as to engage the package leads, the connector is provided with a lever actuated camming means which will now be described in detail.

Figure 1:
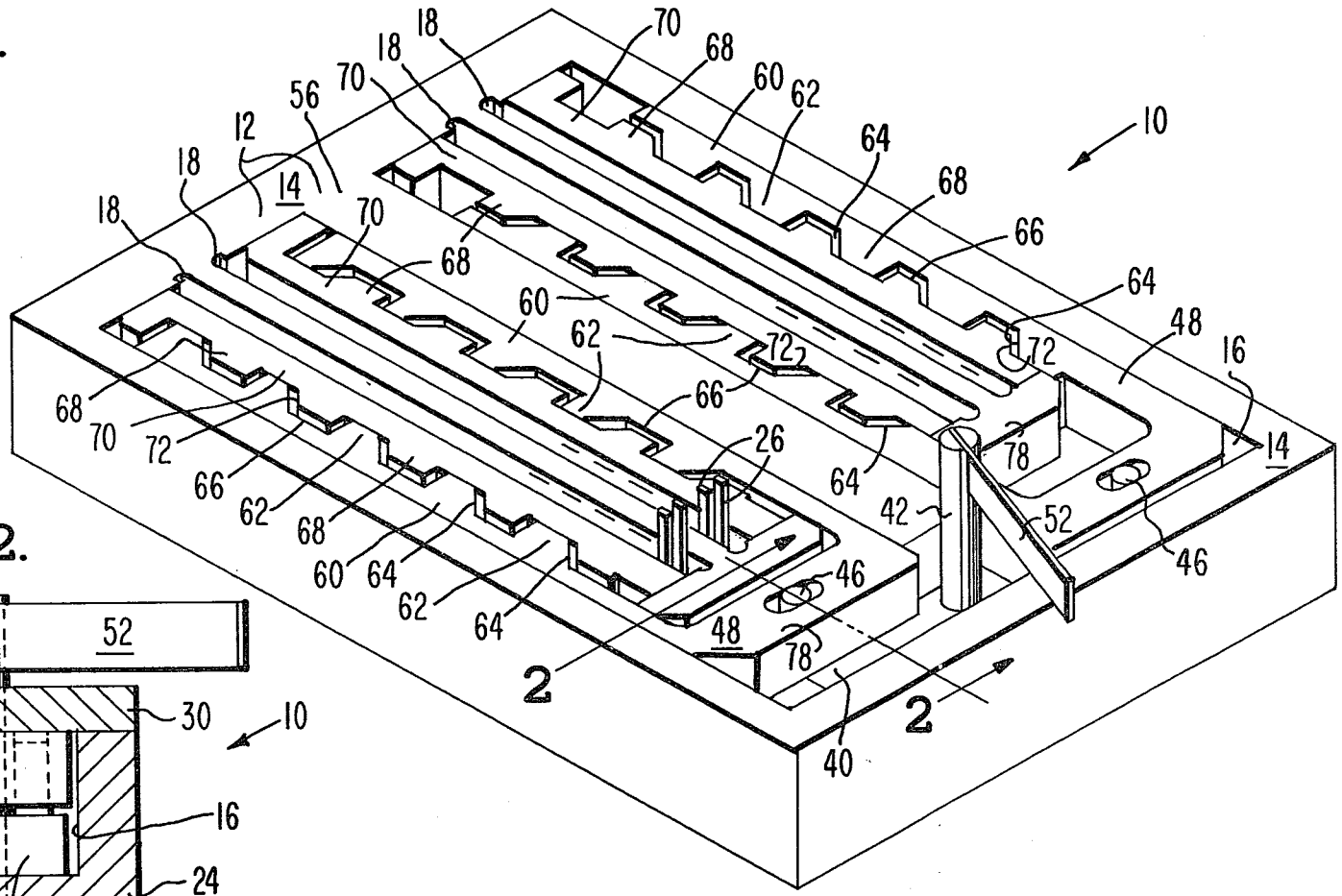
FIG. 1 is a perspective view of the zero insertion force connector constructed in accordance with this invention with the top cover removed to illustrate the inner details thereof.
Figure 2:
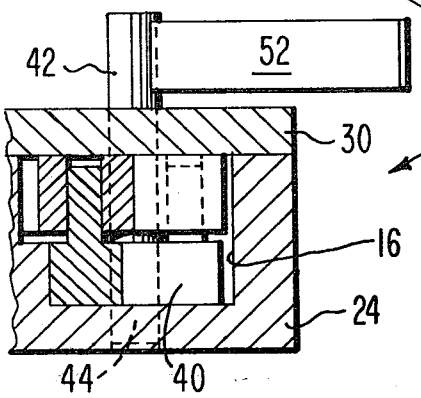
FIG. 2 is a partial cross-sectional view, taken along line 2—2 of FIG. 1, to show the details of the lever for actuating the camming means and also showing the cover on the connector.

Within the recess 16 of the connector 10 is a lever arm 40 centrally pivotally connected on a fulcrum post 42 held within the connector by being positioned in a hole 44 (FIG. 2) in the base 24. Each end of the lever is connected in a lost motion connection on pins 46 on the lever 40 to a pair of U-shaped camming devices 48 which slide longitudinally in the connector in opposite directions in response to the actuation of the lever arm 40 by movement of a handle 52 on the post 42; the latter extending outwardly and beyond the side wall 14 and top 30 of the connector. These camming devices 48 each encompass the pairs of rows 18 of connectors 22 and slide within pairs of subrecesses 54 defined by a centrally located bar 56 and the outer walls 14 of the connector. The bar 56 is integral with the body of the connector. The U-shaped camming devices 48 each with spaced apart camming arms 60 are provided with longitudinally spaced apart projections 62 (five shown) extending toward the centrally located parallel rows 18 of connector leads 22. These projections have camming surfaces or ramps 64 formed at an angle with respect to the parallel rows 18 of connectors 22 and are spaced apart forming pockets 66 to receive complementary projections 68 on pairs of connector engaging bars 70 located between the arms 62 and the parallel rows 18 of connector leads 22. The projections 68 also have ramps 72 which relate to the ramps 64 and form the camming surfaces for movement of the connector engaging bars 70 toward the connector leads where the edges of the bars engage the flared portion 36 of the connector leads 22. Also, as is clear from the drawings, the arms 62 of the U-shaped camming devices 48 actually surround the four connector engaging bars 70 so as to actuate the connector leads located between pairs of connector engaging bars. These connector engaging bars 70 are held against movement in the direction of the oppositely acting camming devices 48 in response to actuation of the lever 40 by a T-shaped stop means 76 also integral with and forming part of the connector body. The cross-bar or head 78 of the T's engage one end of the bars 70 and prevent their longitudinal movement in one direction while the wall 14 prevents their longitudinal movement in the opposite direction. At the same time, bars 70 are able to move transverse to the sliding longitudinal movement of the camming devices for forcing the connector leads together to engage the inserted package leads. The resiliency of the spaced apart flared portions 36 of the connector leads also serve to move the bars 70 outwardly out of disengagement with the package leads when the camming devices are inactivated.

Figure 3:
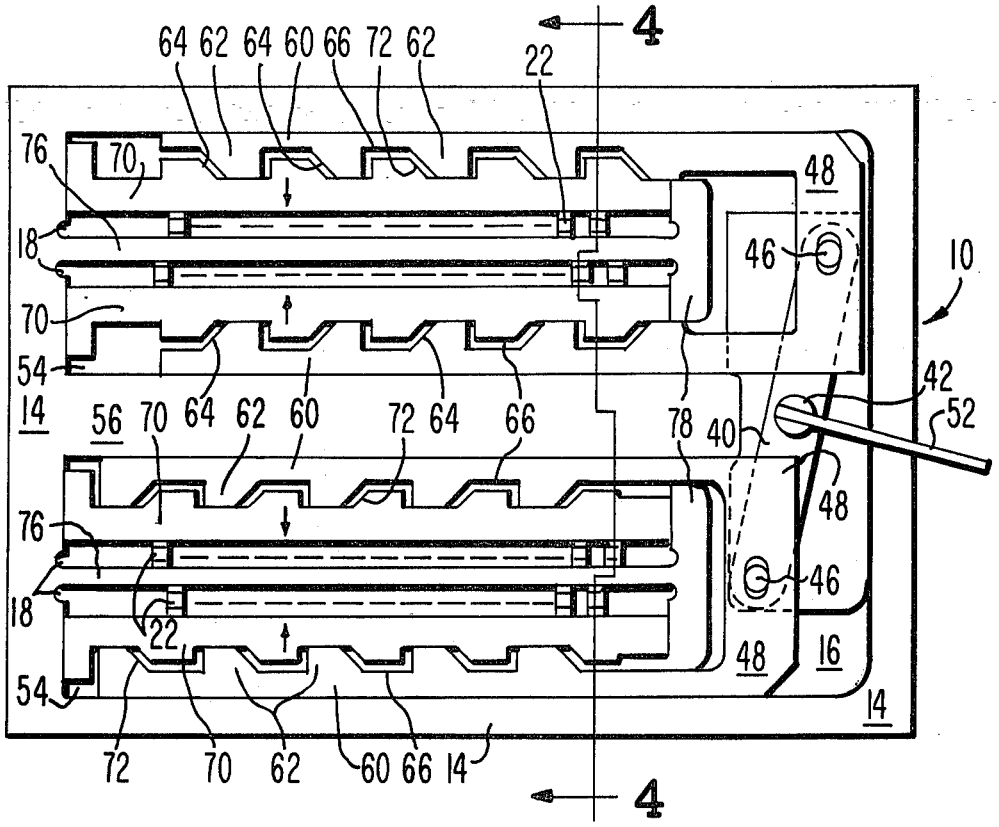
FIG. 3 is a top plan view, again with the cover removed, to illustrate the details of the level actuated camming means.
Figure 5:
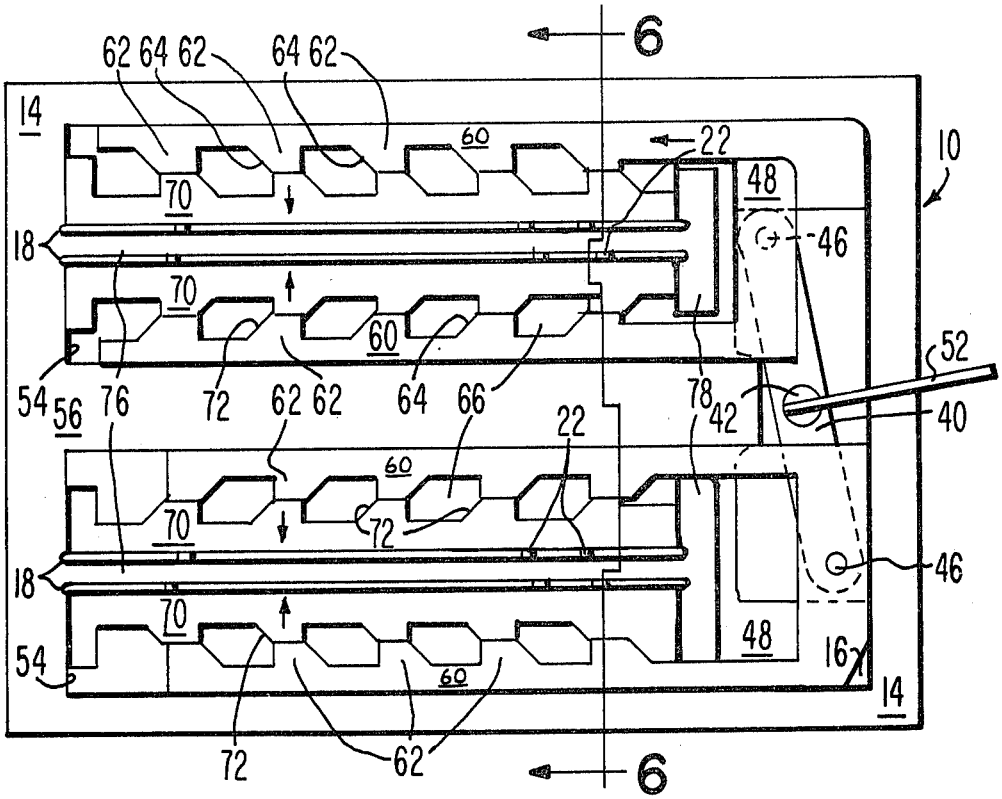
FIG. 5 is a top plan view like FIG. 3 but showing the connector leads engaging the package leads.

From the foregoing it can be seen that there is disclosed a zero insertion force connector 10 with parallel rows 18 of spring biased connector leads 22 for receiving staggered package leads 26. When the package leads 26 are inserted in the apertures 32 in the connector cover 30, the spaced apart portions 36, 38 of the connector leads receive the leads 36. Then by operation of handle 52 the leads 22 close in and engage the leads 26 against the lead's spring bias in a positive mechanical operation by the camming action involved in the ramps 64 and 72, FIG. 3 to FIG. 5. A reversal of the handle 52 reverses the function of the ramps, FIG. 5 to FIG. 3, and the bias of the connector leads portions 36, 38 open the connector leads and allow the package to be removed.

What is claimed is:

1. A zero insertion force connector for receiving an integrated circuit package with staggered leads, comprising:

a connector body defining a recess, resilient conductive connector means for receiving and engaging said staggered leads to form an electrical contact therewith, camming actuator means mounted in said recess, camming means connected to said camming actuator means for sliding movement relative to said connector body on actuation of said camming actuator means, and connector engaging means responsive to said camming means for moving transverse to the sliding movement of said camming means to cause said connector means to engage said staggered leads when inserted in said connector means, said connector means actuating said connector engaging means for transverse movement to said camming means to move said engaging means out of engagement with said staggered leads or to receive said staggered leads.

2. The connector as claimed in claim 1, wherein said actuator means comprises a lever arm centrally pivotally connected within said recess and a handle for moving said lever arm.

3. The connector as claimed in claim 2, wherein said camming means comprises parallel arms coupled at one end in a U-shaped configuration, said arms having inwardly extending camming surfaces for engaging complementary camming surfaces on said connector engaging means.

4. A connector as claimed in claim 3, wherein said parallel arms move in opposite directions in response to said centrally pivoted lever arm for causing said camming surfaces to move said connector engaging means toward said staggered leads.

5. A connector as claimed in claim 4, wherein said connector engaging means comprises pairs of arms located in parallel and in opposite sides of said staggered leads.

6. A connector as claimed in claim 5, wherein said parallel arms of said camming means each have one pair of said connector engaging arms move the arms of each pair of connector engaging arms toward each other.

* * * * *